US007975320B2

(12) United States Patent
Muskovitz et al.

(10) Patent No.: US 7,975,320 B2
(45) Date of Patent: Jul. 12, 2011

(54) HELMET INCLUDING VENT AND ACTUATOR ASSEMBLY FOR MOVING VENT SHUTTER AND METHODS OF USING SAME

(75) Inventors: David T. Muskovitz, Park City, UT (US); Christopher G. Miller, Draper City, UT (US)

(73) Assignee: Smith Optics, Inc., Ketchum, ID (US)

( * ) Notice: Subject to any disclaimer, the term of this patent is extended or adjusted under 35 U.S.C. 154(b) by 1353 days.

(21) Appl. No.: 11/314,072

(22) Filed: Dec. 20, 2005

(65) Prior Publication Data

US 2007/0136932 A1 Jun. 21, 2007

(51) Int. Cl.
*A63B 71/10* (2006.01)

(52) U.S. Cl. ..... 2/425; 2/410

(58) Field of Classification Search ..... 2/410, 411, 2/425

See application file for complete search history.

(56) References Cited

U.S. PATENT DOCUMENTS

| | | | | |
|---|---|---|---|---|
| 3,444,288 | A | 5/1969 | Mead | 264/161 |
| 3,668,704 | A | 6/1972 | Conroy et al. | 2/3 |
| 3,860,966 | A | 1/1975 | Brown et al. | 2/415 |
| 3,994,021 | A | 11/1976 | Villari et al. | 2/413 |
| 4,060,855 | A | 12/1977 | Rappleyea | 2/413 |
| 4,081,865 | A | 4/1978 | Bergee et al. | 2/425 |
| 4,115,874 | A | 9/1978 | Hasegawa | 2/425 |
| 4,141,085 | A | 2/1979 | Adams, Sr. | 2/410 |
| 4,290,150 | A | 9/1981 | Guerre-Berthelot | 2/421 |
| 4,404,690 | A | 9/1983 | Farquharson | 2/420 |
| 4,612,675 | A | 9/1986 | Broersma | 2/424 |
| 4,627,115 | A | 12/1986 | Broersma | 2/425 |
| 4,766,614 | A | 8/1988 | Cantwell et al. | 2/414 |
| 4,845,786 | A | 7/1989 | Chiarella | 2/412 |
| 4,942,628 | A * | 7/1990 | Freund | 2/416 |
| 4,995,117 | A | 2/1991 | Mirage | 2/410 |

(Continued)

FOREIGN PATENT DOCUMENTS

CH 666389 7/1988

(Continued)

OTHER PUBLICATIONS

"Our Thermostat™" Helmet Ventilation Control, viewed Jun. 21, 2006, also available at http://www.giro.com/main.html.

*Primary Examiner* — Shaun R Hurley
*Assistant Examiner* — Andrew W Sutton
(74) *Attorney, Agent, or Firm* — Dorsey & Whitney LLP

(57) ABSTRACT

The invention is directed to protective helmets having vents with a manually operable vent shutter and methods of using same. In one embodiment, a helmet includes an outer shell, an upper liner, a lower liner, and a vent shutter positioned within a space defined by the upper and lower liners. The helmet includes at least one vent formed through the outer shell, upper liner, and lower liner. The helmet further includes an actuator assembly operable to move the vent shutter to open and close the at least one vent. The actuator assembly includes an engagement member, such as a gear. The engagement member engages the vent shutter and effects movement of the vent shutter when rotated relative to the vent shutter about the rotation axis. In another embodiment, the upper liner may be omitted and the vent shutter may be disposed between the interior of the outer shell and the lower liner.

36 Claims, 5 Drawing Sheets

U.S. PATENT DOCUMENTS

| | | | | | |
|---|---|---|---|---|---|
| 5,014,366 | A | | 5/1991 | Discipio, Sr. | 2/424 |
| 5,088,130 | A | | 2/1992 | Chiarella | 2/411 |
| 5,093,938 | A | | 3/1992 | Kamata | 2/424 |
| 5,123,121 | A | | 6/1992 | Broersma | 2/421 |
| 5,150,479 | A | | 9/1992 | Oleson | 2/414 |
| 5,165,116 | A | | 11/1992 | Simpson | 2/424 |
| 5,170,510 | A | | 12/1992 | Nava | 2/414 |
| 5,170,511 | A | | 12/1992 | Kamata | 2/424 |
| 5,271,103 | A | | 12/1993 | Darnell | 2/418 |
| 5,345,614 | A | | 9/1994 | Tanaka | 2/425 |
| 5,361,419 | A | | 11/1994 | Bernstein | 2/423 |
| 5,448,780 | A | | 9/1995 | Gath | 2/424 |
| 5,680,656 | A | | 10/1997 | Gath | 2/424 |
| 5,734,994 | A | | 4/1998 | Rogers | 2/411 |
| 5,829,065 | A | | 11/1998 | Cahill | 2/418 |
| 5,901,369 | A | * | 5/1999 | Pilney | 2/6.5 |
| 5,915,537 | A | | 6/1999 | Dallas et al. | 2/410 |
| 5,940,889 | A | | 8/1999 | Shirai | 2/411 |
| 5,950,244 | A | | 9/1999 | Fournier et al. | 2/414 |
| 5,950,245 | A | * | 9/1999 | Binduga | 2/417 |
| 6,009,562 | A | | 1/2000 | Bullock et al. | 2/422 |
| 6,061,834 | A | | 5/2000 | Liao | 2/171.3 |
| 6,070,271 | A | | 6/2000 | Williams | 2/412 |
| 6,105,172 | A | | 8/2000 | Shida | 2/171.3 |
| 6,105,176 | A | | 8/2000 | Egger | 2/425 |
| 6,122,773 | A | | 9/2000 | Katz | 2/171.3 |
| 6,151,718 | A | | 11/2000 | Shirai | 2/410 |
| 6,170,090 | B1 | | 1/2001 | Minor | 2/411 |
| 6,298,497 | B1 | | 10/2001 | Chartrand | 2/414 |
| 6,708,376 | B1 | * | 3/2004 | Landry | 24/68 R |
| 6,904,618 | B2 | | 6/2005 | Musal | 2/425 |
| 2002/0124298 | A1 | | 9/2002 | Muskovitz | 2/410 |
| 2003/0747722 | | | 4/2003 | Lee | 2/424 |
| 2004/0064873 | A1 | * | 4/2004 | Muskovitz | 2/410 |

FOREIGN PATENT DOCUMENTS

| | | |
|---|---|---|
| DE | 4009036 | 9/1991 |
| EP | 320622 | 6/1989 |
| EP | 474942 | 12/1990 |
| EP | 638251 | 2/1995 |
| GB | 2075820 | 11/1981 |
| JP | 04018106 | 1/1992 |
| JP | 05044102 | 2/1993 |
| JP | 06041807 | 2/1994 |
| WO | WO8603950 | 7/1986 |

* cited by examiner

HELMET INCLUDING VENT AND ACTUATOR ASSEMBLY FOR MOVING VENT SHUTTER AND METHODS OF USING SAME

TECHNICAL FIELD

This invention relates to helmets having vents. More particularly, this invention relates to helmets having vents that may be opened and closed using an actuator assembly.

BACKGROUND OF THE INVENTION

Helmets and other forms of protective headgear have become increasingly popular in recent years as users have become more aware and concerned about preventing head injuries while participating in sporting events. Numerous forms of special helmets have been developed for use in a wide range of indoor and outdoor sporting activities.

Some early protective helmets did not provide adequate ventilation. Accordingly, such helmets often caused the user to undesirably perspire profusely. Perspiration can cause the user to lose energy and, if goggles or glasses are worn by the user, the perspiration can cause fogging of the goggles or glasses. Adequate ventilation is particularly important in sports, such as skiing and snowboarding, where the participant may significantly exert themselves and perspire.

A number of different helmets having ventilation systems have been developed. One conventional helmet design having a ventilation system is disclosed in U.S. Pat. No. 6,904,618 to Musal ("'618 patent"). The '618 patent discloses a helmet having a plurality of vents formed therein. A shutter plate is rotatably mounted within a recess in a shock-absorbing liner of the helmet. The shutter plate is rotatably mounted in a manner that allows the shutter plate to be rotated to a first position in which apertures in the shutter plate are aligned with the vents in the helmet so that the vents are substantially open and a second position in which the apertures in the shutter plate are not aligned with the vents in the helmet so that the vents are closed. To open and close the shutter plate, an exposed elongated slot is formed in the front or rear of the helmet and a lever attached to the shutter plate extends through the slot. The user may manually slide the lever along the length of the slot to rotate the shutter plate between the first and second positions. U.S. Patent Application Publication US2004/0064873 to Muskovitz ("'873 Publication") discloses another configuration for a ventilation system in which the user manually slides a lever along a slot formed in the helmet to move a shutter plate to open and close vents formed in the helmet.

While the helmets disclosed in the '618 patent and the '873 Publication provide effective ventilation systems, the seal between the helmet and the shutter plate is not always sufficient to prevent moisture from leaking into the interior of the helmet. The elongated slots are exposed to the outside environment and provides access for moisture, such as rain or melting snow, to the interior of the helmet. The exposed slot can also ice over making movement of the lever within the slot more difficult. Additionally, the small lever for moving the shutter plate between the open and closed positions can be difficult to operate with a bulky glove or mitten commonly worn by skiers and snowboarders.

Therefore, there is still a need in the art for a helmet suitable for use in outdoor sports, such as skiing and snowboarding, having an actuator assembly configured for moving a shutter plate or the like to open and close vents in the helmet that does not allow a significant amount of moisture to leak through to the interior of the helmet. It would also be desirable that the actuator assembly have a low profile and be easy for the user to manually operate with bulky handwear, such as gloves and mittens, commonly worn during skiing and snowboarding.

SUMMARY OF THE INVENTION

The invention is directed to apparatuses and methods for protective helmets having vents that may be opened and closed using an actuator assembly. In one aspect of the invention, a helmet includes a helmet body having at least one vent formed therein, a vent shutter moveable relative to the helmet body, and an actuator assembly. The actuator assembly includes an engagement member rotatable relative to the vent shutter about a rotation axis. The engagement member is configured to engage the vent shutter and operable to move the vent shutter when rotated about the rotation axis to open and close the at least one vent.

Another aspect of the invention is directed to a method of moving a vent shutter of a helmet to control air flow through at least one vent formed in the helmet. The method includes rotating an engagement member to engage the vent shutter and moving the vent shutter to a selected position responsive to rotation of the engagement member.

DETAILED DESCRIPTION OF THE EMBODIMENTS

Figure 1:
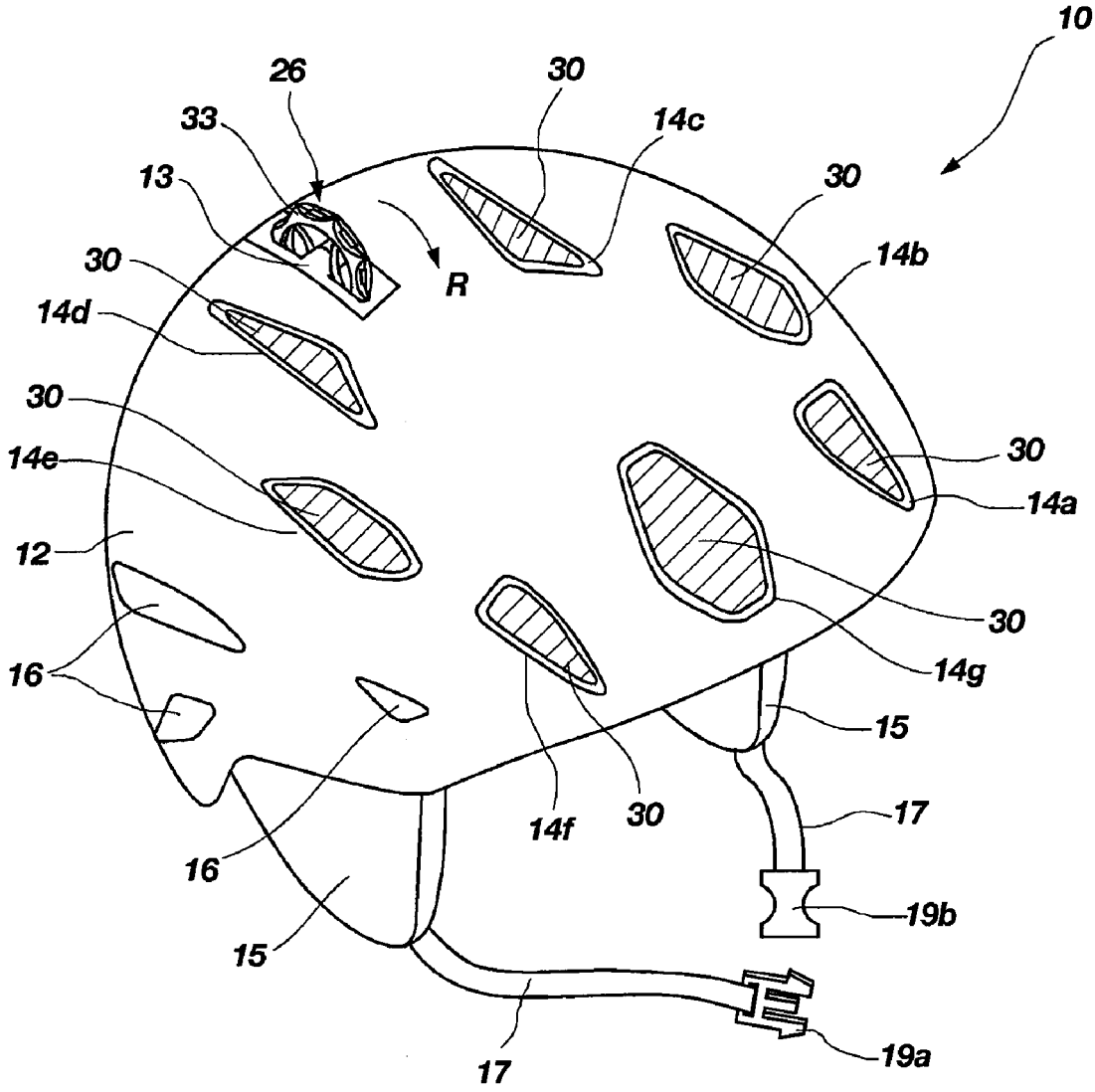
FIG. 1 is an isometric view of a protective helmet according to one embodiment of the invention.

The invention is directed to apparatuses and methods for protective helmets having vents that may be opened and closed using an actuator assembly. Many specific details of certain embodiments of the invention are set forth in the following description and in FIGS. 1 through 5 in order to provide a thorough understanding of such embodiments. One skilled in the art, however, will understand that the invention may have additional embodiments, or that the invention may be practiced without several of the details described in the following description. In the figures and description below, like or similar reference numerals are used to represent like or similar elements.

FIG. 1 is an isometric view of a protective helmet 10 in accordance with one embodiment of the invention. The helmet 10 includes an outer shell 12 having a plurality of vents 14*a*-14*g* formed therein and a vent shutter 30 shown in its closed position closing the vents 14*a*-14*g* to prevent air flow to the interior of the helmet 10. The outer shell 12 is also shown with optional vents 16 that are always open to air flow. The outer shell 12 may be formed as a hard shell from impact resistant plastics that can withstand significant impacts and temperature variations without fracture. Examples of such materials include molded polycarbonate, acrylonitrile-butadiene-styrene (ABS), or another suitable impact resistant material. The vent shutter 30 may be formed of a substantially air-impermeable plastic material. The helmet 10 further includes an actuator assembly 26 having an engagement member 33 that extends through an opening (not shown in FIG. 1) in the outer shell 12. A cap 13 laterally surrounds the engagement member 33 and may help prevent moisture from leaking into the interior of the helmet 10. The engagement member 33 is operable to move the vent shutter 30 to open and close the vents 14*a*-14*g* formed in the outer shell 12 when manually rotated in the direction R. The structure and operation of the actuator assembly 26 will be discussed in more detail below with respect to FIGS. 3 and 5.

To secure the helmet 10 to the head of the user and provide additional comfort and protection from the environment, ear covers 15 may be attached to the helmet 10 and have straps 17 extending therefrom with suitable buckles 19*a* and 19*b* configured to interlock with each other.

Figure 2:
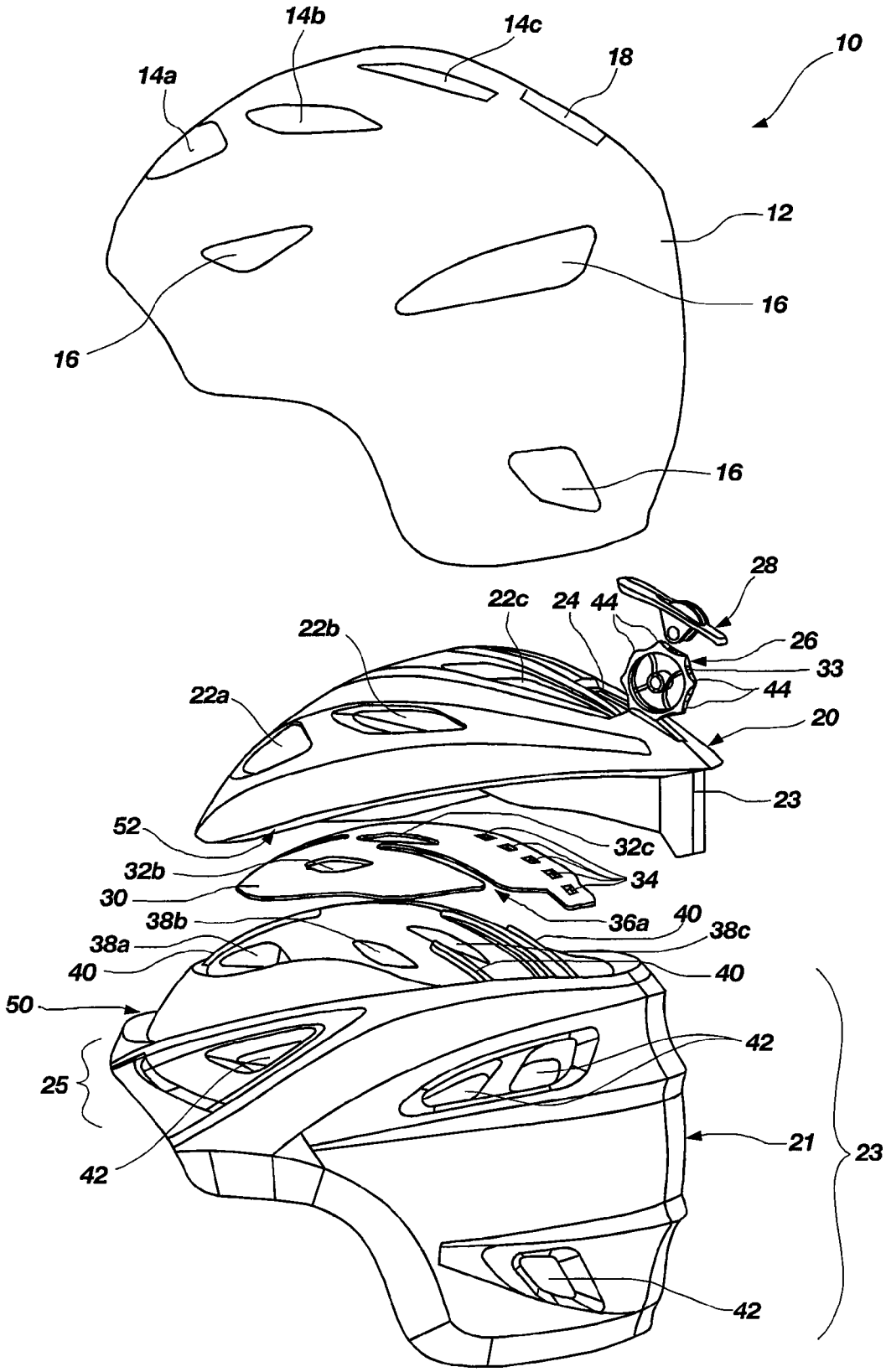
FIG. 2 is an exploded side isometric view of the protective helmet of FIG. 1.

FIG. 2 is an exploded side isometric view of the helmet 10 shown in FIG. 1. The helmet 10 includes the outer shell 12, an upper liner portion 20, a lower liner portion 21, all of which collectively define a helmet body. The upper and lower liner portions 20 and 21 may be formed from lightweight shock absorbing materials, such as molded styrene, polystyrene, expanded plastic, or another suitable lightweight shock absorbing material. The vent shutter 30 of the helmet 10 is disposed between a space (shown as space 56 in FIG. 4) defined by the upper and lower liner portions 20 and 21. The outer shell 12 is configured to fit over and enclose the upper and lower liner portions 20 and 21 when the upper and lower liner portions 20 and 21 are assembled together providing a hard impact resistant protective layer. The outer shell 12 also includes an opening 18 located in a rear portion of the outer shell 12 through which a portion of the engagement member 33 extends through.

The lower liner portion 21 is suitably shaped to fit on the user's head. The lower liner portion 21 includes a downwardly contoured portion 23 configured to fit to the back of the user's head and neck, and an upwardly contoured portion 25 configured to fit adjacent the user's forehead and face. The lower liner portion 21 is shaped to define a dome shaped upper portion 50 configured to be received by a lower portion 52 of the upper liner portion 20 and define the space 56 (not shown in FIG. 1, See FIG. 4) in which the vent shutter 30 may slide within. The lower liner portion 21 includes a plurality of vents 38*a*-38*g* formed therein that are shaped and dimensioned to correspond with the shape and dimension of the vents 14*a*-14*g* of the outer shell 12. The lower liner portion 21 may also include a plurality of vents 42. The vent shutter 30 is disposed between the upper and lower liner portions 20 and 21. The vent shutter 30 may be formed so that it has a curvature that generally corresponds and conforms to the curvature of the upper portion 50 of the lower liner portion 21 and the curvature of the lower portion 52 of the upper liner portion 20. The upper liner portion 20 also includes a plurality of vents 22*a*-22*g* shaped and dimensioned to correspond with the shape and dimension of the vents 14*a*-14*g* of the outer shell 12. Accordingly, the vents 14*a*-14*g* of the outer shell 12, the vents 22*a*-22*g* of the upper liner portion 20, and the vents 38*a*-38*g* of the lower liner portion 21 collectively form passageways that air may flow into the interior of the helmet 10 to cool the user.

The helmet 10 may be formed by assembling the upper and lower liner portions 20 and 21 together with the vent shutter 30 disposed therebetween and bonding the upper and lower liner portions 20 and 21 together using a suitable adhesive. The outer shell 12 may also be bonded to the assembly of the upper and lower inner portions 20 and 21 using a suitable adhesive. When the outer shell 12, upper liner portion 20, and lower liner portion 21 are assembled and bonded together, the respective vents 14*a*-14*g*, vents 22*a*-22*g*, and vents 38*a*-38*g* are substantially aligned with each other. Also, if present, the vents 16 of the outer shell 12 are substantially aligned with the vents 42 of the lower liner portion 21.

Figure 3:
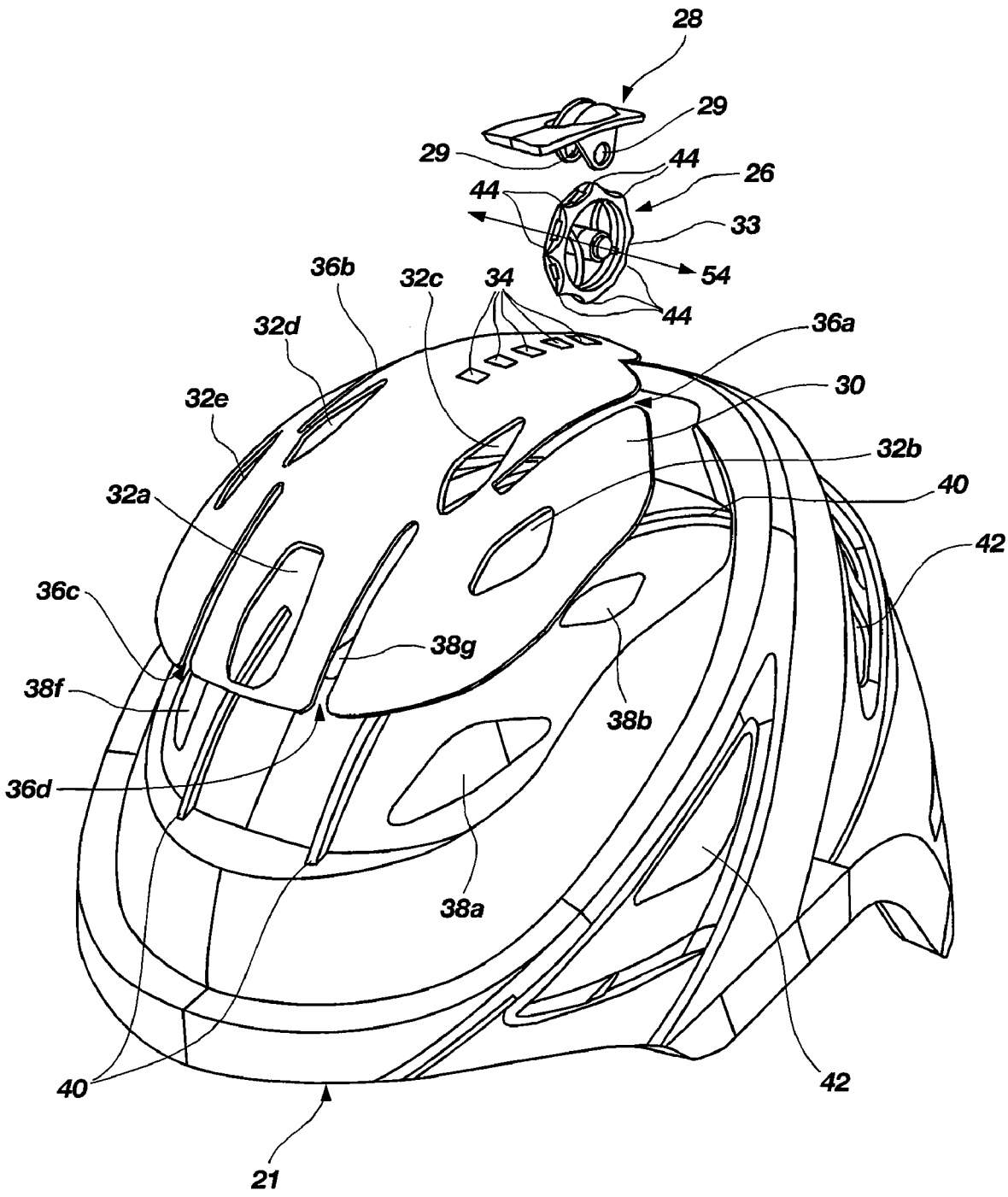
FIG. 3 is an exploded top isometric view of FIG. 1 with the outer shell and upper liner portion removed.

As best shown in FIGS. 2 and 3, the vent shutter 30 includes a plurality of vents 32*a*-32*e*. The vent shutter 30 may be selectively moved, by actuation of the actuator assembly 26, to an open position so that the vents 32*b*-32*e* and 32*a* of the vent shutter 30 are substantially simultaneously aligned with the corresponding vents 38*b*-38*e* and 38*g* of the lower liner portion 21, corresponding vents 22*b*-22*e* and 22*g* of the upper liner portion 20, and corresponding vents 14*b*-14*e* and 14*g* of the outer shell 12. The vents 14*a* and 14*f* of the outer shell 12, vents 38*a* and 38*f* of the lower liner portion 21, and vents 22*a* and 22*f* of the upper liner portion 20 are not obstructed by the vent shutter 30 when the vent shutter 30 is positioned in the open position. Accordingly, air is allowed to flow through the vents 14*a*-14*g*, 22*a*-22*g*, and 38*a*-38*g* to help cool the user and prevent them from overheating and subsequently perspiring during activity such as skiing and snowboarding. Similarly, the vent shutter 30 may be selectively moved, by actuation of the actuator assembly 26, to a closed position so that the vents 32*b*-32*e* and 32*a* of the vent shutter 30 are not aligned with the corresponding vents 38*b*-38*e* and 38*g* of the lower liner portion 21, corresponding vents 22*b*-22*e* and 22*g* of the upper liner portion 20, and corresponding vents 14*b*-14*e* and 14*g* of the outer shell 12 in order to substantially simultaneously close the vents 14*a*-14*g*.

In addition to the plurality of vents 32*a*-32*e*, the vent shutter 30 also includes a plurality of alignment slots 36*a*-36*d*. A first slot 36*a* may be formed between the vents 32*b* and 32*c*, a second slot 36*b* between the vents 32*d* and 32*e*, and a third slot 36*c* and a fourth slot 36*d* adjacent to the vent 32*g*. As best shown in FIG. 3, each of the alignment slots 36*a*-36*d* are configured to receive an alignment member 40 formed on the upper portion 50 of the lower liner portion 21. Accordingly, the vent shutter 30 may move forwardly and rearwardly under actuation of the actuator assembly 26 along the alignment members 40 guided by corresponding alignment slots 36*a*-36*d*. In the embodiment of the vent shutter 30 shown in FIGS. 2 through 4, the vent shutter 30 also includes a plurality of longitudinally spaced recesses 34 formed in the rear portion of the vent shutter 30 that are spaced apart and sized to be engaged by the actuator assembly 26 when rotated.

The arrangement of the vents 32*a*-32*e* of the vent shutter 30 and the manner in which the vent shutter 30 is guided when actuated by the actuator assembly 26 may be modified in accordance with other embodiments of the invention. For example, the spacing, shape, and number of vents 32*a*-32*e* may be altered according to various embodiments.

Figure 4:
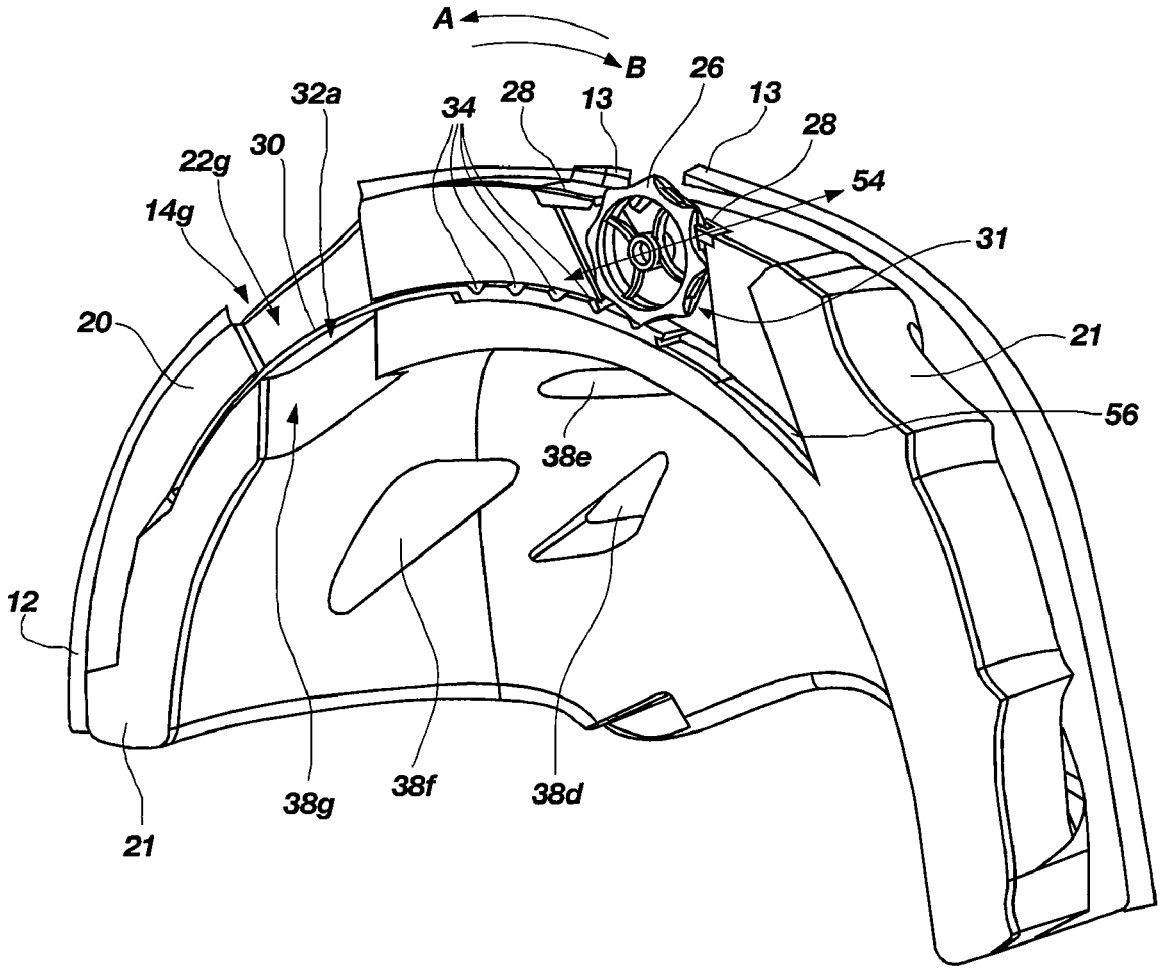
FIG. 4 is a side sectional isometric view of FIG. 1.
Figure 5:
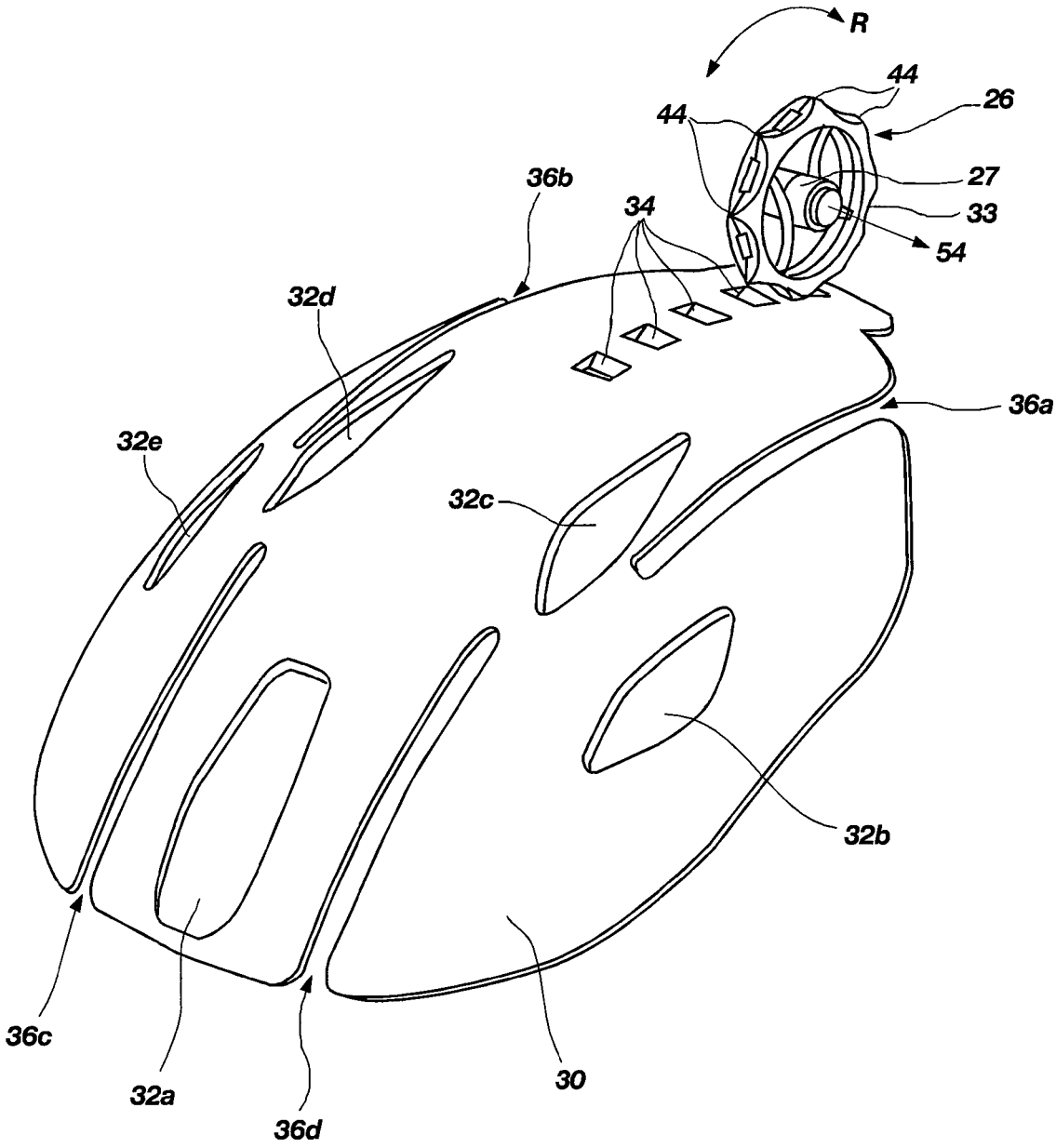
FIG. 5 is a top isometric view of the vent shutter of FIGS. 1 through 4 and its associated engagement member.

With reference to FIG. 3 through 5, the structure of the actuator assembly 26 and its associated carriage 28 will be discussed in more detail. The actuator assembly 26 may be positioned in a rear portion of the helmet 10 and includes the engagement member 33 and the carriage 28. As best shown in the side sectional isometric view of FIG. 4, the engagement member 33 and portions of the carriage 28 are positioned within a suitably sized recess 31 formed in the upper liner portion 20. The engagement member 33 and portions of the carriage 28 are secured within the recess 31 by bonding the carriage 28 to portions of the upper liner portion 20 adjacent the recess 31. Although the actuator assembly 26 is shown positioned in a rear portion of the helmet 10, in another embodiment, the actuator assembly 26 may be positioned in a front portion of the helmet 10. In yet another embodiment, the actuator assembly 26 may be positioned in one of the lateral portions of the helmet 10 and effect movement of the vent shutter 30 laterally from one side of the helmet 10 to the other side of the helmet 10.

The engagement member 33 may be in the form of a gear with teeth 44, according to one embodiment. The engagement member 33 may include an axle 27 configured to be received by openings 29 of the carriage 28 and rotatably supported by the carriage 28. Although the axle 27 is shown being integrally formed with the engagement member 33, according to other embodiments, the axle 27 may be integrally formed with the carriage 28 or the axle 27 may be a separate component that is attached to the carriage 28 and the engagement member 33.

In operation, the engagement member 33 may be manually rotated in the direction R about an axis 54 extending through the axle 27 to effect movement of the vent shutter 30. The pitch of the teeth 44 of the engagement member 33 and the spacing of the recesses 34 is such that the teeth 44 of the engagement member 33 and the recesses 34 cooperate to move the vent shutter 30 when the engagement member 33 is rotated in the direction R. Clockwise rotation of the engagement member 33 slides the vent shutter 30 forwardly along an arc A to close the vents 14*a*-14*g* substantially simultaneously and counterclockwise rotation of the engagement member 33 slides the vent shutter 30 rearwardly along an arc B to open the vents 14*a*-14*g* substantially simultaneously. As best shown in FIG. 5, the teeth 44 of the engagement member 33 continuously engage the recesses 34 as the engagement member 33 is rotated until the vent shutter 30 is translated a sufficient amount such that there is no longer one of the recesses 34 positioned to receive one of the teeth 44 if the engagement member 33 is continued to be rotated in the same direction.

During operation of the embodiment of the vent shutter 30/actuator assembly 26, when the engagement member 33 is rotated counter clockwise in the direction R until it cannot be rotated anymore, the vent shutter 30 is in its open position with the vents 14*a*-14*g* unobstructed so that air may flow therein to cool the user. When the engagement member 33 is rotated clockwise in the direction R until it cannot be rotated anymore, the vent shutter 30 is in its closed position with the vents 14*a*-14*g* completely closed so that air cannot substantially flow therein to the interior of the helmet 10. Accordingly, the user may selectively move the vent shutter 30 to a plurality of positions to vary the degree to which the vents 14*a*-14*g* are obstructed by the vent shutter 30. Depending upon the user's desire, by manually rotating the engagement member 33 a selected amount the vent shutter 30 may be positioned so that it partially obstructs the vents 14*a*-14*g*.

The engagement member 33 of the actuator assembly 26 provides a low profile structure that is easily manually manipulated by a user wearing a bulky glove or mitten commonly worn during sports such as skiing and snowboarding. The configuration of the carriage 28 and the cap 13 that attaches to the exterior of the outer shell 12 and through which the engagement member 33 extends may also help prevent moisture, such as rain or melting snow, from leaking through the outer shell 12 and into the interior of the helmet 10. Additionally, the actuator assembly 26 may be less likely to pool or conglomerate moisture or snow therein, which can freeze and prevent adequate functioning of the actuator assembly 26.

Although the embodiment of the actuator assembly 26 shown in FIGS. 1 through 5 included a single engagement member 33 to effect movement of the vent shutter 30, in another embodiment, the actuator assembly 26 may include more than one engagement member. For example, a first gear may physically engage the vent cover 30 and a second gear may be manually manipulated by the user and effect rotation of the first gear. Other actuator assembly configurations may be employed to convert rotational motion into translational motion of the vent shutter 30.

In another embodiment, the upper liner portion 20 may be eliminated and the vent shutter 30 may be disposed between the interior of the outer shell 12 and the lower liner portion 21. In such an embodiment, the carriage 28 may be secured to the outer shell 12 or the lower liner portion 21.

Although the invention has been described with reference to the disclosed embodiments, persons skilled in the art will recognize that changes may be made in form and detail without departing from the spirit and scope of the invention. For example, the actuator, vent shutter, and vent configurations may be used in a variety of different types of helmets besides helmets for use in outdoor sporting activities such as skiing and snowboarding. Such modifications are well within the skill of those ordinarily skilled in the art. Accordingly, the invention is not limited except as by the appended claims.

What is claimed is:

1. A helmet, comprising:

a helmet body including at least one vent formed therein;

a vent shutter moveable relative to the helmet body; and an actuator assembly including an engagement member rotatable relative to the vent shutter about a rotation axis, the engagement member positioned within an opening in the helmet body and a portion of the engagement member extending above a surface of the helmet body to allow the engagement member to be manually rotated, the engagement member having a plurality of teeth located around the periphery of the engagement member and configured to engage the vent shutter in a manner to that causes the vent shutter to move responsive to rotation of the engagement member thereby opening or closing the at least one vent.

2. The helmet of claim 1 wherein:

the at least one vent comprises a plurality of vents; and the vent shutter comprises a plurality of openings dimensioned and arranged to substantially align with the plurality of vents of the helmet body when the vent shutter is in a first position.

3. The helmet of claim 2 wherein the engagement member is operable to move the vent shutter to substantially simultaneously open and close the plurality of vents.

4. The helmet of claim 1 wherein the engagement member is operable to move the vent shutter to open and close the at least one vent a selected amount depending upon a degree the engagement member is rotated.

5. The helmet of claim 1 wherein:

the helmet body comprises an exterior surface and an interior surface; and the vent shutter is positioned adjacent to the interior surface.

6. The helmet of claim 1 wherein the engagement member of the actuator assembly comprises a gear suitable sized to be manually rotated, the gear having a plurality of teeth configured to engage recesses formed in the vent shutter.

7. The helmet of claim 6 wherein the recesses are linearly spaced apart.

8. The helmet of claim 6 wherein the actuator assembly comprises:

an axle attached to the gear, the gear being positioned within an opening formed in the helmet body; and a carriage rotatably supporting the axle and attached to the helmet body.

9. The helmet of claim 1:

wherein the helmet body comprises:

an outer shell including the at least one vent;

a first liner having at least one first liner vent aligned with the at least one vent of the outer shell;

a second liner having at least one second liner vent aligned with the at least one first liner vent; and wherein the vent shutter is disposed between the first liner and the second liner, the at least one opening of the vent shutter being selectively alignable by actuation of the actuator assembly with the at least one first liner vent and the at least one second liner vent.

10. The helmet of claim 9 wherein the vent shutter comprises a first surface having a curvature corresponding to the curvature of the first liner and a second surface having a curvature corresponding to the curvature of the second liner.

11. The helmet of claim 1 wherein the helmet body comprises a composite structure.

12. The helmet of claim 1 wherein each of the first and second liners comprises a material selected from the group consisting of polycarbonate and ABS.

13. The helmet of claim 1 wherein:

the helmet body comprises a front portion and a rear portion; and the actuator assembly is positioned within a rear portion of the helmet body.

14. The helmet of claim 1 wherein:

the helmet body comprises a front portion and a rear portion; and the actuator assembly is positioned within a front portion of the helmet body.

15. The helmet of claim 1 wherein:

the helmet body comprises a front portion, a rear portion, and lateral portions; and the actuator assembly is positioned within one of the lateral portions of the helmet body.

16. The helmet of claim 1 wherein the actuator assembly is operable to move the vent shutter toward a front portion of the helmet body when the engagement member is rotated about the rotation axis in a first direction and to move the vent shutter toward a rear portion of the helmet body when the engagement member is rotated about the rotation axis in a second direction.

17. The helmet of claim 1 wherein:

the vent shutter comprises alignment slots; and the helmet body comprises a liner defining a space in which the vent shutter is disposed within, the liner comprising alignment members received by corresponding alignment slots.

18. The helmet of claim 1 wherein the engagement member is operable to move the vent shutter linearly along a longitudinal path.

19. A helmet, comprising:

a helmet body including an inner surface, an outer surface, and a plurality of apertures formed therein extending between the inner and outer surfaces;

a plate having a plurality of apertures formed therein, the plate being movable between a first position in which each of the plurality of apertures in the plate is aligned with a respective one of the plurality of apertures in the helmet body, and a second position in which the plate substantially obstructs the plurality of apertures in the helmet body; and an actuator assembly including an engagement member that is rotatable relative to the plate about a rotation axis and is positioned within an opening the helmet body so that a portion of the engagement member projects from the outer surface of the helmet body, the engagement member having a plurality of teeth located around a periphery of the engagement member and configured to engage the plate and operable to move the plate between its first and second positions when the engagement member is rotated about the rotation axis.

20. The helmet of claim 19 wherein the engagement member is operable to move the plate to partially obstruct the plurality of apertures in the helmet body to a degree that depends upon a degree the engagement member is rotated when the plate is between its first and second positions.

21. The helmet of claim 19 wherein the plate is positioned adjacent to the interior surface of the helmet body.

22. The helmet of claim 19 wherein the engagement member of the actuator assembly comprises a gear having a plurality of teeth configured to engage recesses formed in the plate.

23. The helmet of claim 22 wherein the engagement member is positioned so that the teeth project from the outer surface of the helmet body.

24. The helmet of claim 22 wherein the recesses are linearly spaced apart.

25. The helmet of claim 22 wherein the actuator assembly comprises:

an axle attached to the gear, the gear being positioned within an opening formed in the helmet body; and a carriage rotatably supporting the axle and attached to the helmet body.

26. The helmet of claim 19:

wherein the helmet body comprises:

an outer shell in which the plurality of apertures are formed;

a first liner having a plurality of apertures aligned with respective ones of the plurality of apertures of the outer shell;

a second liner having a plurality of apertures aligned with respective ones of the plurality of apertures of the first liner vent; and wherein the plate is disposed between the first liner and the second liner, the plurality of apertures in the plate being aligned with respective ones of the plurality of apertures in the first and second vent liners when the plate is in its first position.

27. The helmet of claim 26 wherein the plate comprises a first surface having a curvature corresponding to the curvature of the first liner and a second surface having a curvature corresponding to the curvature of the second liner.

28. The helmet of claim 19 wherein:

the helmet body comprises a front portion and a rear portion; and the actuator assembly is positioned within a rear portion of the helmet body.

29. The helmet of claim 19 wherein the actuator assembly is operable to move the plate to its first position when the engagement member is rotated about the rotation axis in a first direction and to move the plate to its second position when the engagement member is rotated about the rotation axis in a second direction.

30. The helmet of claim 19 wherein:

the plate comprises alignment slots; and the helmet body comprises a liner defining a space within which the plate is disposed, the liner comprising alignment members received by corresponding alignment slots.

31. The helmet of claim 19 wherein the engagement member is operable to move the plate linearly along a longitudinal path.

32. The helmet of claim 19 wherein the plate is formed from an air-impermeable material.

33. The helmet of claim 1 wherein the engagement member is configured to cause the vent shutter to move in a first direction responsive to rotation of the engagement member in a first direction thereby opening the at least one vent and wherein the engagement member is further configured to cause the vent shutter to move in a second direction responsive to rotation of the engagement member in a second direction thereby closing the at least one vent.

34. The helmet of claim 33 wherein the rotation of the engagement member in the first direction is opposite the rotation of the engagement member in the second direction.

35. A helmet, comprising:

a helmet body including one or more vents formed therein;

a vent shutter moveable relative to the helmet body; and an engagement wheel having a plurality of teeth at an outer perimeter thereof, the engagement wheel positioned in an opening in the helmet body and a portion of the engagement wheel extending above a surface of the helmet body, the engagement wheel configured to rotate about an axis, the teeth of the engagement configured to directly engage with the vent shutter in a manner that causes the vent shutter to move in response to the engagement wheel being rotated.

36. The helmet of claim 35 wherein the vent shutter moves in a direction that is perpendicular to axis of rotation of the engagement wheel.

* * * * *